US005236175A

United States Patent [19]

Campau

[11] Patent Number: 5,236,175

[45] Date of Patent: Aug. 17, 1993

[54] THREE POSITION LIVEWELL CONTROL VALVE

[75] Inventor: Daniel N. Campau, Grand Rapids, Mich.

[73] Assignee: Flow-Rite Controls, Ltd., Grand Rapids, Mich.

[21] Appl. No.: 713,626

[22] Filed: Jun. 10, 1991

Related U.S. Application Data

[63] Continuation of Ser. No. 502,186, Mar. 30, 1990, abandoned.

[51] Int. Cl.[5] ..... F16K 8/00

[52] U.S. Cl. ..... 251/304; 43/57

[58] Field of Search ..... 251/304; 43/57

[56] References Cited

U.S. PATENT DOCUMENTS

| | | | |
|---|---|---|---|
| 4,589,441 | 5/1986 | Campau | 137/512 |
| 4,708,084 | 11/1987 | Campau | 137/512 X |
| 4,832,073 | 5/1989 | Campau | 137/110 |
| 4,948,095 | 8/1990 | Campau | 251/304 X |
| 5,010,836 | 4/1991 | Riviezzo | 251/304 X |

*Primary Examiner*—John C. Fox

*Attorney, Agent, or Firm*—Niro, Scavone, Haller & Niro

[57] ABSTRACT

A water distribution system for use between a water source and a livewell in a boat, capable of use with a boat in either moving or stationary states in the water source, and including means for operating the water distribution system in any one of three modes: a recirculate-only mode, a dual fill and recirculate mode, and a drain without refilling mode. Means are also provided, by utilization of an apparatus achieving tactile feedback, for apprising the operator of when the system is operating properly in a drip-tight, recirculation-only mode.

9 Claims, 5 Drawing Sheets

Fig. 4
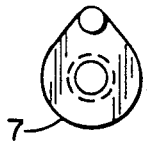
Fig. 5
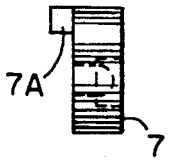
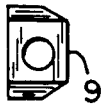
Fig. 9
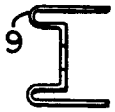
Fig. 10
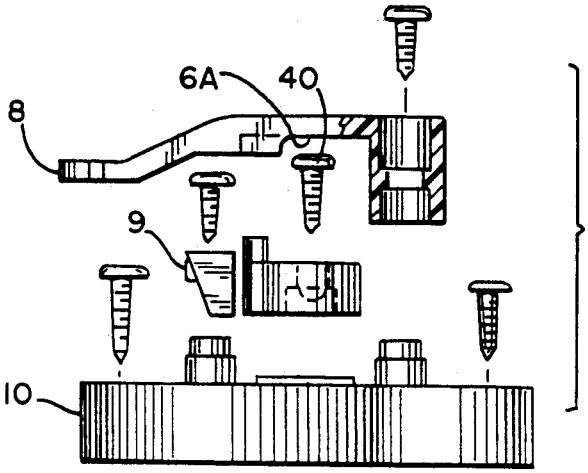
Fig. 6
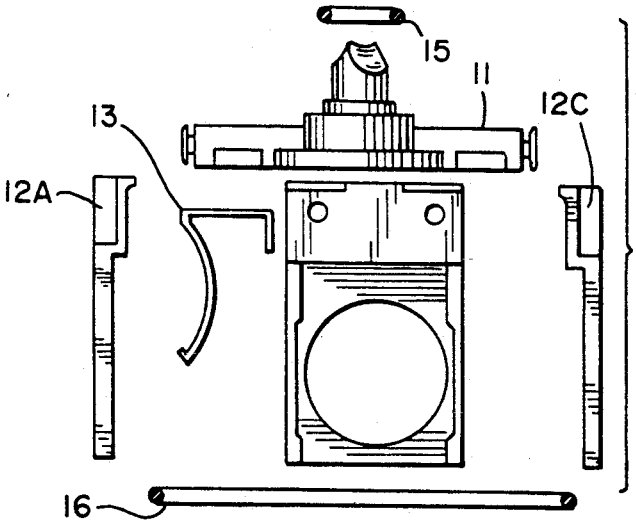
Fig. 7
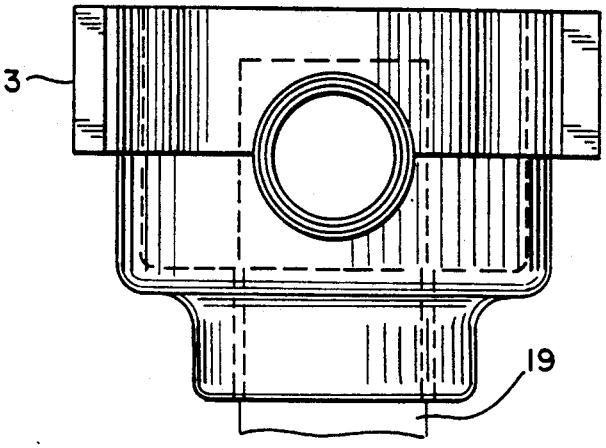
Fig. 8

Fig. 16
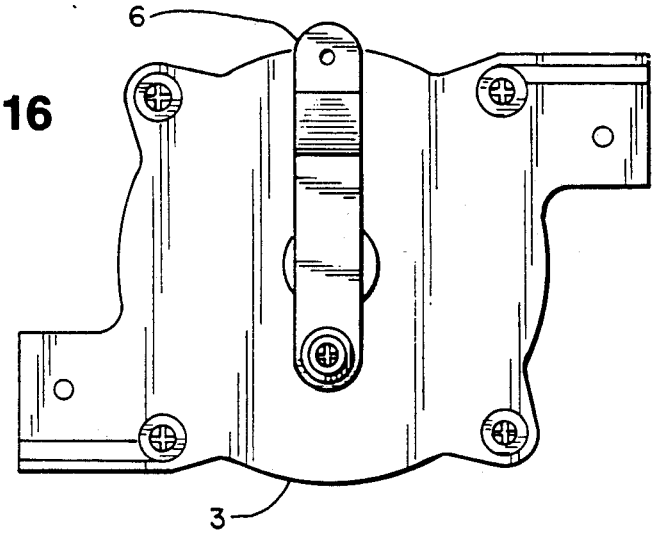
Fig. 17
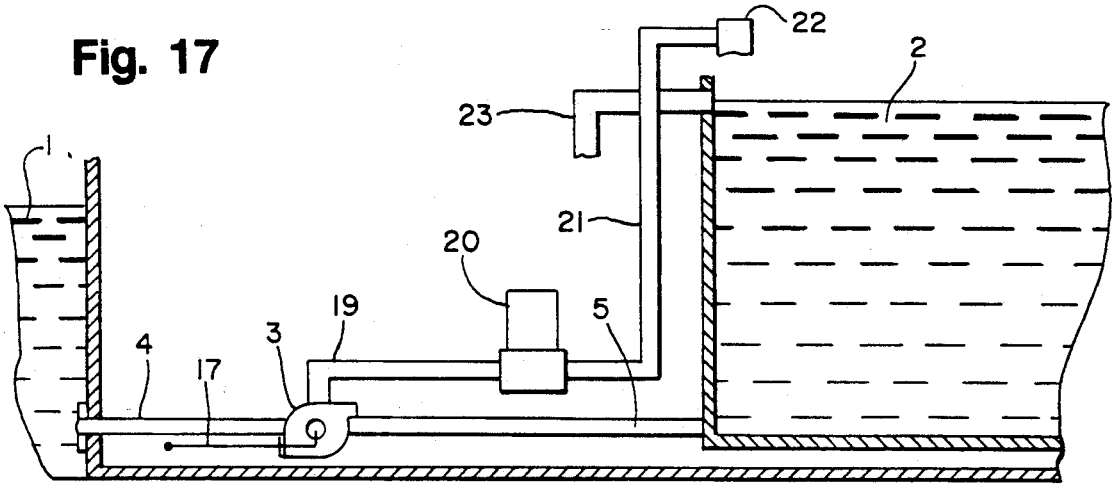
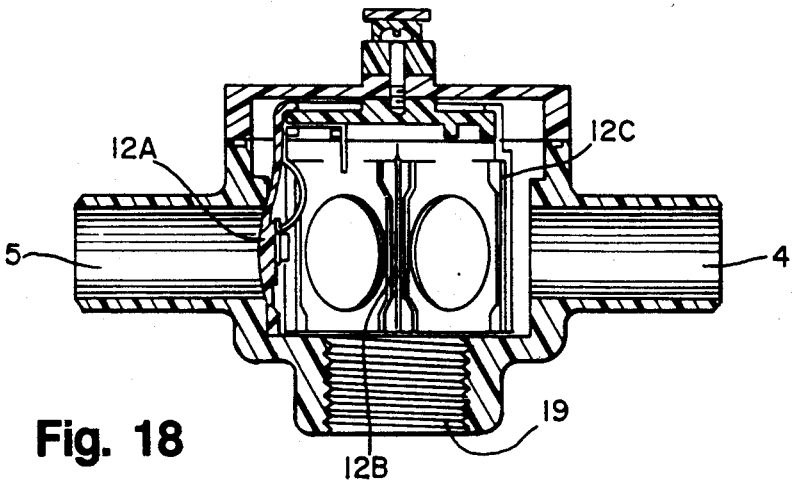
Fig. 18

Fig. 19
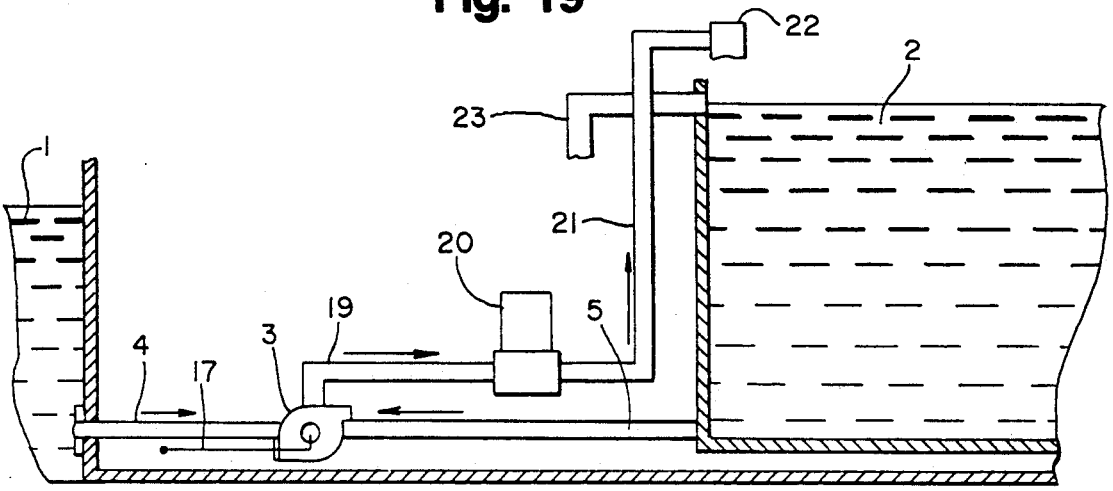
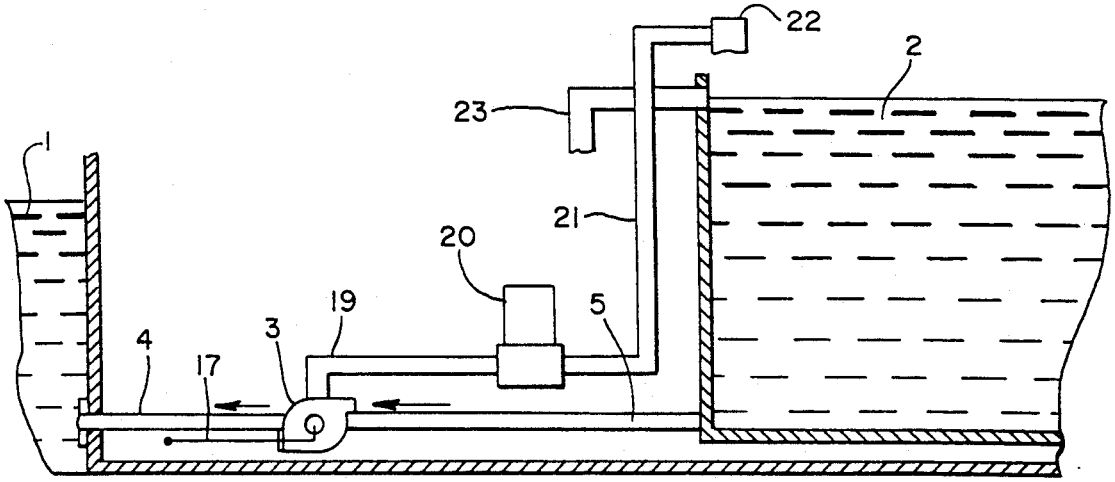
Fig. 20

THREE POSITION LIVEWELL CONTROL VALVE

This is a continuation of copending application Ser. No. 07/502,186 filed on Mar. 30, 1990 now abandoned.

BACKGROUND OF THE INVENTION

U.S. Pat. No. 4,708,084 and U.S. Pat. No. 4,948,095 are hereby incorporated by reference into this disclosure.

The invention relates generally to a water distribution system for directing the flow of water between a reservoir, such as a livewell on a fishing boat, and a water source, such as a lake or river.

The water distribution systems disclosed in U.S. Pat. Nos. 4,589,441 and 4,708,084 represent typical prior art apparatus for controlling the flow of water between a livewell and an external water source. These systems are used widely by many manufacturers of sport fishing boats. They achieve various advantages such as use of only a single pump to both fill the livewell and recirculate livewell water through the system's aeration device; and, the ability, when the boat is running, to automatically prevent loss of livewell water out the drain port, while continuing to draw water from the livewell drain for recirculation and aeration.

However, while commercially successful, the water distribution systems described in U.S. Pat. Nos. 4,589,411 and 4,708,084 nonetheless suffer from various disadvantages. For example, these prior art systems cannot prevent outside water from being drawn into the livewell by the aerator pump while the boat is still or moving slowly. This "recirculate-only" mode is desirable to prevent drawing hot or muddy water into the livewell when fishing shallow water. It also can be used, to cite another example, when chemicals, such as tranquilizers or ph treatments, are to be added to the livewell without diluting the chemical's effectiveness.

There are also situations in which the flapper valve described in U.S. Pat. Nos. 4,589,441 and 4,708,084 is too flexible to prevent a loss of water. For instance, when the boat is running in rough water, an oscillating pressure wave can occur in the livewell drain. This can cause the flapper to oscillate between open and closed positions, allowing a significant amount of water to leak from the livewell during long runs. Leakage can also occur when the boat is out of the water, as the pump suction can lift the flapper from sealing contact with its valve seat.

It would therefore be desireable to provide a water distribution system for a livewell which could operate in a "recirculate-only" mode, and which would overcome the effect of pressure oscillations in the drain line and resist the suction created by the aerator pump.

SUMMARY OF THE INVENTION

This invention is designed to maintain all the advantages of the water distribution systems described in U.S. Pat. Nos. 4,589,441 and 4,708,084, while overcoming the disadvantages already generally described.

An object, therefore, of the present invention is to provide a water distribution system for directing the flow of water between a livewell and a water source which, in addition to the operational modes described in U.S. Pat. Nos. 4,589,441 and 4,708,084, can operate in a "recirculate-only" mode in a boat that is either still or moving at a slow speed.

A second object of the present invention is to provide such a water distribution system which will overcome the effect of pressure oscillations in the drain line and resist the small suction created by the pump to provide drip-tight sealing in the livewell's transom drain line.

A third object of the present invention is to provide the operator with reliable, tactile feedback means for determining when the valve is properly positioned for drip-tight sealing in the "recirculate-only" mode. Such a solution solves dual problems of variations in dimensional tolerance and cable hysteris.

These objects are achieved in the flow control valve of the present invention, which valve construction is disclosed in and otherwise similar to the two-flapper valve of U.S. Ser. No. 07/344,000, by the addition of a third, spring-loaded flapper positioned adjacent the transom valve port. This third flapper is properly positioned by a detent clip providing tactile feedback to an operator.

Therefore, the present invention is directed to a water distribution system for use between a water source and a livewell placed in a boat; this system can be operated with a boat in either moving or stationary states in the water source. The system allows a single valve, in fluid communication with a single pump, to operate the system in any one of three modes: a "recirculate-only" mode, a dual fill and recirculate mode, and a drain without refilling mode. The system also includes a means for providing tactile feedback of the valve position to an operator.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIGS. 4 and 5 show top and side views, respectively, of the follower link.

FIG. 6 is a cross sectional side view of the valve arm, detent clip, follower link and cap assembly.

FIGS. 7 and 8 are cross sectional side views of the valve chamber, and elements therein.

FIGS. 9 and 10 show top and side views, respectively, of the detent clip.

FIGS. 15 and 16 show top views of the assembled valve.

FIG. 17 is a diagrammatic view of the water distribution system as it operates in the "recirculate-only" mode for a stationary boat.

FIG. 18 is a cross-sectional side view of the three-position control valve showing the three ports and three flappers.

FIG. 19 is a diagrammatic view of the water distribution system as it operates in the "dual fill and recirculate" mode.

FIG. 20 is a diagrammatic view of the water distribution system as it operates in the "drain without refilling" mode.

DETAILED DESCRIPTION OF THE INVENTION

Figure 1:
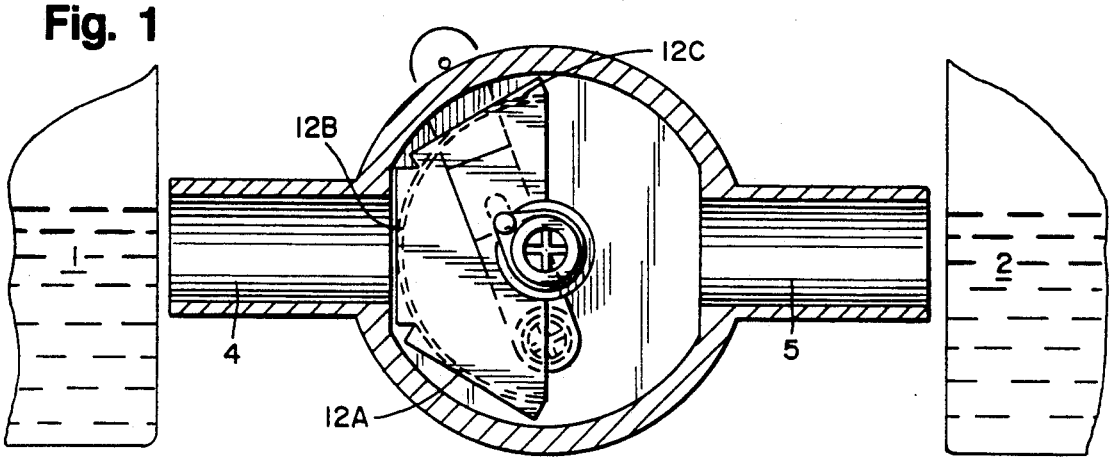
FIG. 1 is a cross sectional top view of the three-position control valve with the rotor in the dual fill and recirculate position.
Figure 2:
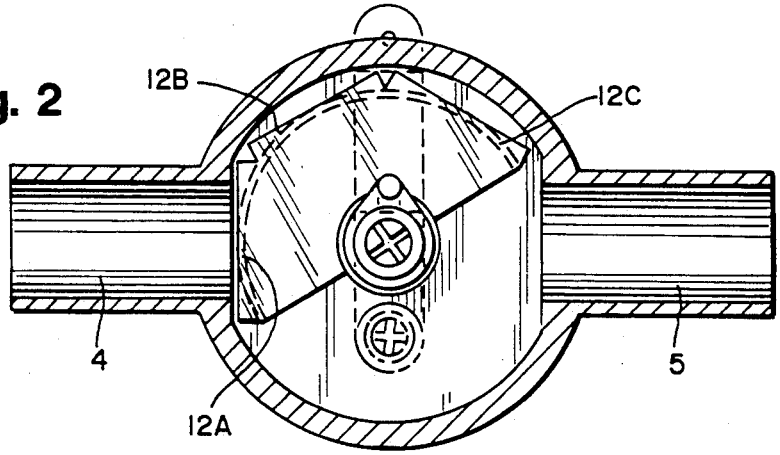
FIG. 2 is a cross sectional top view of the three-position control valve with the rotor in the "recirculate only" position.
Figure 3:
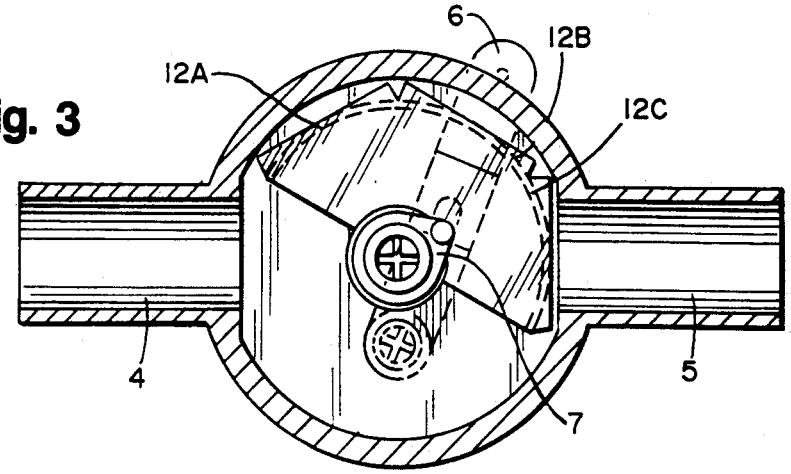
FIG. 3 is a cross sectional top view of the three-position control valve with the rotor in the drain without refilling position.

Referring to the drawings in greater detail, the invention can be seen in three different operational modes in FIGS. 1, 2 and 3; these drawings illustrate the rotor positions and valve linkage mechanism for the three-position livewell control valve which is the subject of this invention. (While the positions for flappers 12A, 12B and 12C are shown in FIG. 1, the flappers themselves are not shown in FIGS. 1-3.) Referring now to FIG. 1, the invention is generally directed to a system for directing the flow of water between a water source 1, such as a lake or river, and a reservoir, such as a livewell 2 which is used on fishing vessels for keeping alive the fish caught. Typically, the livewell 2 is filled to a pressure equalized level by utilizing the water source's natural water pressure. (See, for example, the water distribution system shown in FIG. 4 of U.S. Pat. No. 4,708,084; when the valve 1 of the present invention is operating in the position shown in FIG. 1, the livewell can be filled.)

Once the livewell is filled, it is desireable to replenish and recirculate the livewell water from the water source, as well as to aerate the water coming from the water source to the livewell. This operation can be referred to as a "dual fill and recirculate mode", and is accomplished when the valve is operating in the position shown in FIG. 1 and the pump is turned on. Thus, referring to FIG. 1, water from the water source 1 can flow through pipe 4, past the one-way flapper 12B in valve 3, and into pipe 19 leading to the livewell 2. Additionally, and still referring to FIG. 1, water livewell from pipe 5 can at the same time, due to the negative pressure head generated by water pump 20, flow through valve 3 and back through pipe 19 to an aerator (not shown in FIG. 1). However, livewell water from pipe 5 is prevented from flowing back to the water source via pipe 4 by one-way flapper 12B in valve 3. This operation is achieved without regard to whether the boat is moving or is stationary in the water source. The operation system in the "dual fill and recirculate" mode can be seen generally at FIG. 19.

Referring now to FIG. 3, when the valve is operating in this position, which can be referred to as a "drain without refilling mode", the pump is turned off and livewell water can drain from pipe 5 through pipe 4 into the water source, while water from the water source is prevented from flowing back through pipe 4 toward the livewell (which condition might otherwise occur due to natural pressure differentials between the water source and the livewell) by flapper 12C. the Operation system in the "drain without refilling" mode can be seen generally at FIG. 20.

Referring now to FIG. 2, when the valve arm 6 controlling the third, spring-loaded flapper 12A is positioned as shown, the spring-loaded flapper 12A is positioned over the port of pipe 4 leading to valve 3; this position can be referred to as a "recirculate-only mode". Referring now to FIG. 17, livewell water from pipe 5 cannot flow through pipe 4, but is instead diverted into pipe 19. The negative pressure created by water pump 20 forces the water from pipe 19 into pipe 21 and through the aerator 22. Water is prevented from flowing from the water source 1 through pipe 4 and into pipe 5 by spring-loaded flapper 12A. Therefore, livewell water can only be recirculated through aerator 22 when the valve components are positioned as shown in FIG. 2, even though the boat is still or moving slowly in the water source, and thus will be operating in a "recirculate-only" mode.

This "recirculate-only" mode may be used when any one of the following four conditions occurs: 1) the boat is operating in excessively warm or muddy water; 2) the fisherman desires to add chemicals to his livewell without diluting their effectiveness; 3) an oscillating pressure wave is generated in the livewell drain due to rough water (which would otherwise cause a loss of water out the transom drain port); or 4) the boat is out of the water and the pump is operated (ordinarily creating a need to plug the transom drain port).

The valve and flapper construction necessary to accommodate this third, spring-loaded flapper will now be first generally, and then more specifically, described.

Generally, referring back to FIG. 1, an extra follower link 7 is required to gain an additional 60° of travel for the rotor 11, necessary to have three separate flap positions. Referring now to FIG. 6, in order to properly position a control cable so that the spring-loaded flapper is properly aligned for drip-tight sealing, a detent position is provided. This detent position provides a tactile signal to the operator that the valve is properly aligned to operate in a "recirculate-only" mode with drip-tight sealing. The detent 8 consists of a spring clip 9 mounted on a valve cap 10 located under the arm 6 near a cable attachment point.

Referring more specifically now to FIG. 7, a preferred embodiment of the present invention incorporates the two flappers disclosed in the similar flow control valve described in U.S. Ser. No. 07/344,000, as well as a third, spring-loaded flapper. (FIG. 7 only shows two flapper; the third flapper has been omitted for ease in reading the drawing.) The construction of this third flapper is in accordance with the disclosure in the above-mentioned, pending application. This third flapper should be identical to the first two flappers in order to maintain the same flow characteristics. Accordingly, the same port diameters and general valve dimensions are needed as well. Referring again to FIG. 1, the valve 3 is intersected by three pipes, one pipe 4 leading to the water inlet/outlet port, a second pipe 5 leading to the livewell, and a third pipe 19 leading to water pump 20. When the arm 6 is positioned in the "fill" position, the rotor 11 achieves the flapper position shown in FIG. 1. It is also desireable to maintain the same cable actuator stroke as for a typical flow control valve (i.e., a valve with the two-flapper design shown in FIG. 2 of the '084 patent, in which a 60° rotation of the rotor is required). As each flapper subtends a 60° angle on the rotor, the rotor must rotate 120° to be able to have three separate flapper positions. To achieve the same cable actuator stroke, therefore, an extra link 7 is provided to gain the additional 60° of travel. FIGS. 4 and 5 show top and side views, respectively, of this follower link.

There are additional problems of accuracy and security in positioning the cable so that the spring-loaded flapper is properly aligned in the "recirculate-only"

mode for drip-tight sealing. The actuator lever must resist bumps (such as those which might occur when a boat is being buffeted in rough water) which can move it off-center. Unlike the "fill" and "empty" positions, which have stops at the end of the stroke in each direction, the center position cannot have a stop. Moreover, simply having a mark on the control panel adjacent the center position is not acceptable for two reasons. First, control cables are not uniform. Thus, a variation in the dimensional tolerance which exists on the location of the attachment point (typically a Z bend) of the cable to the valve arm will result in the actuator arm being off-center when the valve is in the center position. The operator would have no way of knowing whether or not the flapper was properly positioned. Second, control cables have some hysterisis—they don't provide exactly the same valve center position in the extension and retraction directions.

The solution to these problems, of which this invention has as one of its objectives, is to provide a detent position for the valve arm that provides a tactile signal to the operator that the third flapper is in the center position. It is important to position this detent as close as possible to the attachment point of the cable to the valve arm. This method assures that a firm detent can be used without placing stress on the valve linkage and pivot points, as such stress can result in excessive strain and lead to inaccurate valve position, as well as excessive wear of critical valve parts. When the valve arm is centered between the "fill" and "empty" positions in the detent position, the rotor and valve linkage is positioned in the manner shown in FIG. 2.

Figure 14:
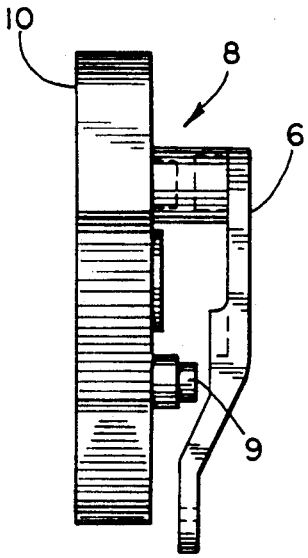
FIG. 14 shows a cross sectional side view of the detent clip fully assembled and mounted on the valve cap under the arm.
Figure 15:
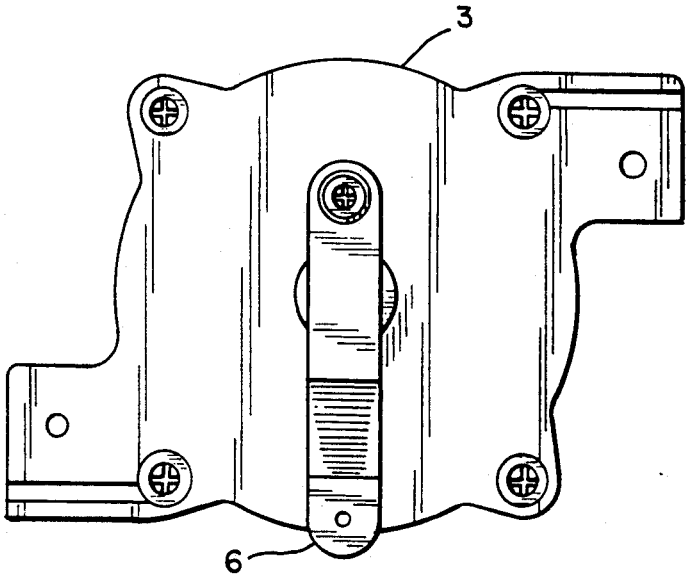

Referring now to FIG. 6, in a preferred embodiment of the invention, the detent 8 consists of a spring clip 9 mounted on the valve cap 10 under the arm 6 near the cable attachment point. FIG. 14 shows a cross sectional side view of the detent clip, fully assembled and mounted on the valve cap under the arm. FIGS. 15 and 16 illustrate that the linkage mounting is reversible. This allows an optional cable approach from either the front or rear.

Figure 11:
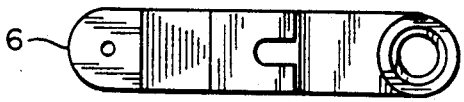
FIG. 11 is a top view of the valve arm.
Figure 12:
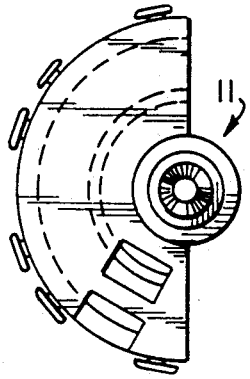
FIGS. 12 and 13 show top and side views, respectively, of the rotor assembly.
Figure 13:
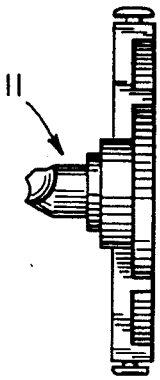

Referring now to FIGS. 7 and 8, the parts of a valve chamber 14 are shown, together with the position of those parts within the valve 14. Thus, an o-ring 15 fits over the center of a rotor assembly 11. Top and side views of this rotor assembly 11 are shown in FIGS. 11 and 12, respectively. Three flappers 12A, 12B and 12C (only two are shown) are incorporated within the periphery of the valve 14; flapper 12A accommodates a biased spring 13. An o-ring 16 is positioned at the bottom of valve 14.

Referring finally to FIG. 17, the water distribution system is shown a it operates in the "recirculate-only" mode for a stationary boat. The arrows show the direction of water flow. With control lever 17 in the center position, flow through pipe 4 is obstructed by the spring-loading flapper in valve 3. Thus, water entering pipe 5 from the livewell 2 is diverted through valve 3 into pipe 19. The negative pressure created by water pump 20 forces water from pipe 19 through pipe 21, and into the aerator 22. Overflow from the livewell 2 flows into the water source 1 from overflow pipe 23. When control lever, 17 is shifted to the "empty" position (see FIG. 3) and the pump 20 is turned off, pipe 5 is blocked by flapper 12C. This non-spring-loaded flapper 12C allows the livewell 2 to drain from pipe 5 while automatically preventing refill through drain line 5. (The particular flapper construction described in U.S. Ser. No. 07/344,000 causes a seal against loss of water when the direction of flow is toward pipe 5.)

FIG. 18 shows a cross-section of the valve of the present invention, with its three flappers and three ports.

What is claimed is:

1. A water distribution system for use between a water source and a livewell in a boat, said system capable of use independent of the speed of the boat in relation to the water source, comprising:

a single pump in fluid communication with a single valve, said valve including a valve chamber defined by a top wall, a bottom wall, a cylindrical sidewall, and three ports communicating with said chamber;

three flexible sealing flappers, a first of said flappers adapted to cover one of said ports to prevent flow through said one port in one direction only, a second of said flappers adapted to cover a second of said ports to prevent flow through said second port in one direction only, and a third of said flappers adapted to cover said second port to prevent flow through said second port in either direction, and a biasing means for urging said third flapper against said sidewall to assist in sealing said second port from said chamber, whereby the water distribution system can be enabled in any one of three separate modes, said three modes including a recirculate-only mode, a dual fill-and-recirculate mode, and a drain-without-refilling mode.

2. The water distribution system of claim 1, wherein said valve is a shut-off valve for use in a low pressure fluid environment, and includes a cylindrical body with three ports defining a valve chamber; and rotatable valve means for controlling flow through said ports, said valve means comprising a rotatable member, three flexible sealing flaps, and a biased spring for urging one of said flaps into sealing contact with said cylindrical body to seal one of said ports from flow through said chamber in one direction only.

3. The water distribution system of claim 1, wherein said valve is cylindrical and has a valve chamber defined by a top wall, a bottom wall and a cylindrical sidewall having at least two ports communicating with said chamber, comprising:

three flexible flaps attached to a rotatable member, and a biased spring, rotatable with one of said flaps, for urging one of said flaps to seal one of said ports on said valve.

4. The water distribution system of claim 3, wherein said biasing spring and said corresponding flap seals said ports without the presence of fluid pressure.

5. The water distribution system of claim 1, further comprising:

means for providing drip-tight sealing while said system is operating in the recirculate-only mode and said pump is operating.

6. The water distribution system of claim 5, wherein said means for providing drip-tight sealing consists of a mechanism providing tactile feedback of the position of said third flexible sealing flapper to an operator.

7. The water distribution system of claim 6, wherein said means for providing drip tight sealing consists of a spring clip located near a cable attachment point.

8. A water distribution system for use between a water source and a livewell in a boat, said system capable of use independent of the speed of the boat in relation to the water source, comprising:

a single pump in fluid communication with a single valve, said valve including means for operating the water distribution system in any one of three separate modes: a recirculate-only mode, a dual fill and recirculate mode, and a drain without refilling mode; said valve also including a valve chamber defined by a top wall, a bottom wall and a cylindrical sidewall having three ports communicating with said chamber; said valve also including three flexible sealing flaps, two of which are adapted to each cover a different one of said ports, to prevent flow through said ports in one direction only; said valve also including a biased spring for urging a third flexible sealing flapper against said sidewall to seal one of said ports from said chamber; and means for providing drip-tight sealing while said water distribution system is operating in the recirculate-only mode and said pump is operating, said means consisting of a mechanism providing tactile feedback of the position of said third flexible sealing flapper to an operator.

9. The water distribution system of claim 8, wherein said means for providing drip-tight sealing includes a spring clip.

* * * * *